US005213223A

United States Patent [19]

Minnette

[11] Patent Number: 5,213,223

[45] Date of Patent: May 25, 1993

[54] CHILD RESISTANT CLOSURE-ADAPTOR

[75] Inventor: Jeffrey C. Minnette, Evansville, Ind.

[73] Assignee: Sunbeam Plastics Corporation, Evansville, Ind.

[21] Appl. No.: 856,380

[22] Filed: Mar. 23, 1992

[51] Int. Cl.[5] ..... B65D 55/02

[52] U.S. Cl. ..... 215/216; 215/221; 215/335; 215/222

[58] Field of Search ..... 215/216, 217, 221, 201, 215/330, 335, 222; 220/288

[56] References Cited

U.S. PATENT DOCUMENTS

| | | | |
|---|---|---|---|
| Re. 6,613 | 8/1875 | Fry . | |
| 15,802 | 9/1856 | Espy . | |
| 40,338 | 10/1863 | Fry . | |
| 58,281 | 9/1866 | Olry . | |
| 73,680 | 1/1868 | Wattis, Jr. . | |
| 3,434,615 | 3/1969 | Barletta . | |
| 3,700,133 | 10/1972 | Bagguley | 215/221 |
| 3,716,161 | 2/1973 | Julian et al. . | |
| 3,866,802 | 2/1975 | Birrell | 215/201 X |
| 3,871,545 | 3/1975 | Béréziat | 215/249 |
| 3,880,314 | 4/1975 | Akers | 215/216 X |
| 3,892,326 | 7/1975 | Schneible | 215/221 |
| 3,944,101 | 3/1976 | Landen et al. | 215/216 |
| 3,967,745 | 7/1976 | Julian | 215/216 |
| 3,989,152 | 11/1976 | Julian | 215/216 |
| 4,241,856 | 12/1980 | Otterson | 215/221 X |
| 4,310,102 | 1/1982 | Walter | 220/288 |
| 4,706,829 | 11/1987 | Li | 220/288 X |
| 4,941,580 | 7/1990 | Julian | 215/235 |
| 5,040,691 | 8/1991 | Hayes et al. | 215/216 |

*Primary Examiner*—Allan N. Shoop
*Assistant Examiner*—Paul A. Schwarz
*Attorney, Agent, or Firm*—Gifford, Groh, Sprinkle, Patmore and Anderson

[57] ABSTRACT

An adaptor and a closure are formed with cooperating child resistant elements so that the adaptor can be applied to any type of container and the closure can be removed from the adaptor only by manipulation of the child resistant stops. Both the adaptor and closure are molded with precision surfaces as by injection molding so that the closure can be sealingly attached to the adaptor without the use of excessive force.

2 Claims, 2 Drawing Sheets

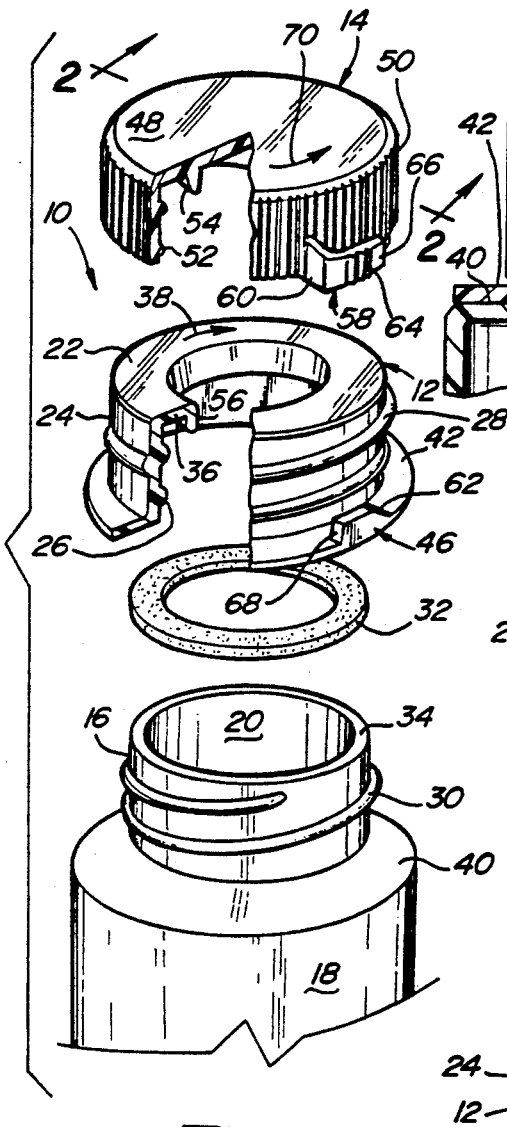
Fig-1
Fig-2
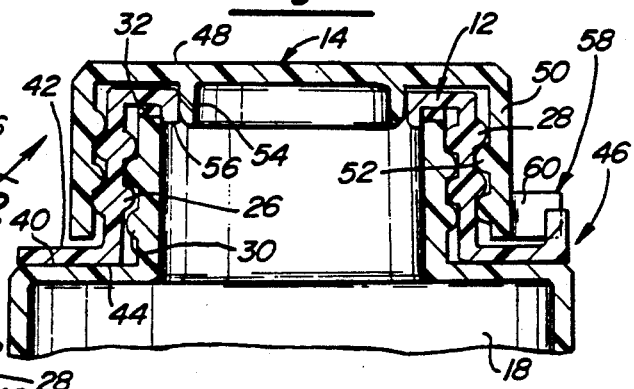
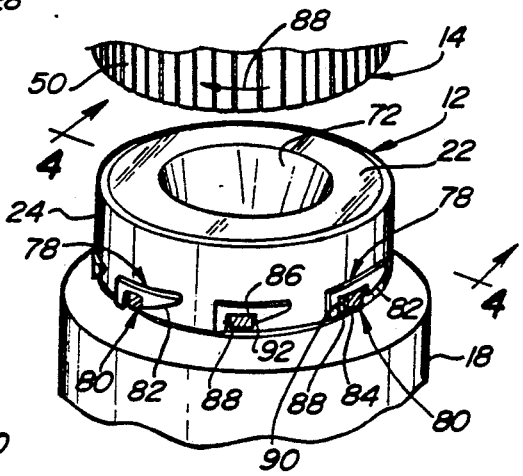
Fig-3
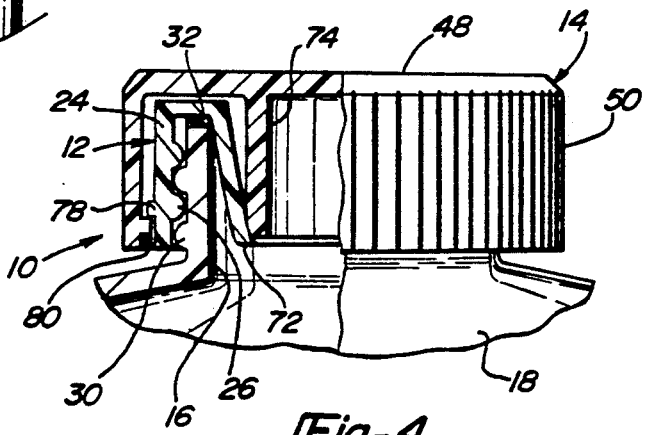
Fig-4

CHILD RESISTANT CLOSURE-ADAPTOR

BACKGROUND OF THE INVENTION

1. Field of the Invention

This invention relates to child-resistant closures. More particularly, this invention relates to means for providing a closure with a child resistant feature to a wide variety of containers including those that have an imprecisely formed container finish.

2. Description of the Related Art

Typically, child resistant closure container packages are produced by providing a child resistant element on the container which coacts with a complimentary element provided on the closure to prevent removal of the closure without manual manipulation of the closure. This additional manipulation coupled with conventional opening motion provides the child resistant feature. The child resistant element unlocking or disengagement manipulation and the opening movement can be sequential or simultaneous.

An example of a chid resistant closure is the Snap-Lok® closure produced by Sunbeam plastics Corporation. This closure is threaded and requires squeezing of a tab on the closure to avoid engagement of stop surfaces as the closure is being unthreaded. Some child resistant closures require pushing or pulling of the cap as it is being unthreaded. Still others require alignment of arrows on the closure and the container to allow a tab on the closure to pass through a slot on a container neck bead.

SUMMARY OF THE INVENTION

The present invention provides means for supplying a cap or closure having a child resistant feature of any type to virtually any type of household product container.

The closure system of the invention provides an adaptor having container engagement means for attaching the adaptor to a container. The adaptor and a closure or cap have complementary attachment means to removably attach the closure to the adaptor, and the adaptor and closure have complementary elements which provide the child resistant feature. Both the adaptor and closure are injection or compression molded to provide precision surfaces for the complementary attachment means and sealing surfaces. This insures a "user friendly" removable closure which seals without the use or excessive force and which has a properly aligned, easy to use, child resistant feature. The adaptor-closure will normally be supplied as an assembled, sealed unit to the manufacturer/bottler.

The adaptor can be attached to the container in a variety of ways such as by the use of a thread, snap bead, ratchet teeth, adhesive bonding, ultra sonic welding and induction heating with a metallic foil-plastic laminate.

When the container has imprecisely formed threads, such as those produced by blow molding, the adaptor can be attached by conventional capping machinery providing high torque to produce a wedging action between the adaptor and container neck providing a permanent connection, all as set forth in my copending patent application Ser. No. 07/841,705 filed Feb. 26, 1992, now U.S. Pat. No. 5,174,460, issued Dec. 29, 1992.

BRIEF DESCRIPTION OF THE DRAWING

The advantages of the present invention will be more apparent from the following detailed description when considered in connection with the accompanying drawing wherein:

FIG. 1 is an exploded perspective view of the closure-adaptor of this invention showing the assembly of the closure cap to the adaptor with cooperating child resistant elements and the adaptor to a container neck with the use of an intermediate gasket or insert;

FIG. 2 is a partial elevational view in cross section of the closure-adaptor of FIG. 1 shown in the assembled condition and in its fully closed position with the cooperating child resistant elements locking the adaptor to the container neck;

FIG. 3 is a partial exploded view of a portion of a closure and an adaptor on a container neck showing an alternate form of cooperating child resistant locking elements and attachment means in the form of a bayonet connection;

FIG. 4 is a partial elevational view in cross section of the closure-adaptor of FIG. 3 taken along the line 4—4 of FIG. 3;

DESCRIPTION OF THE PREFERRED EMBODIMENTS

Figure 5:
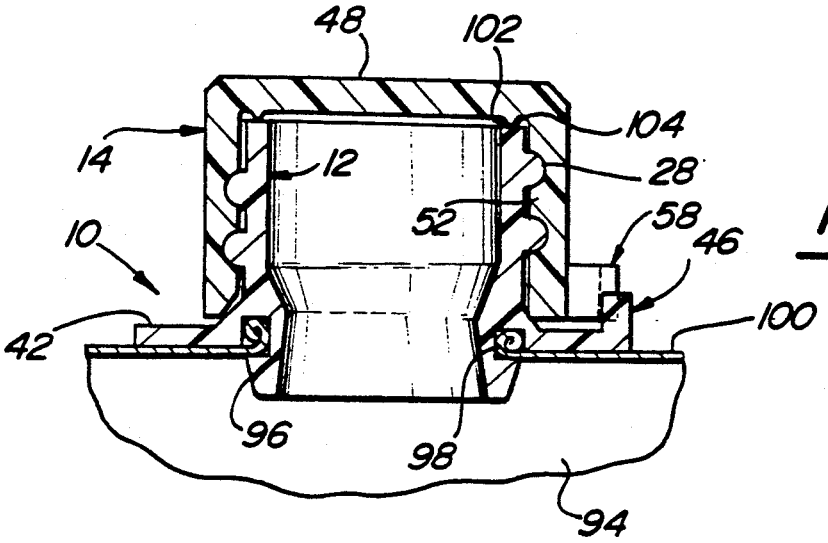
FIG. 5 is a partial elevational view in cross section of the closure-adaptor of this invention with the adaptor modified to permanently attach to the top of metal can.

Referring to FIGS. 1 and 2, the closure-adaptor 10 of the present invention is shown as including an adaptor 12 and a closure 14 which is applied to the neck 16 of a container 18 to removably seal access to the contents of the container through opening 20.

Both the adaptor 12 and the closure 14 are precision formed as by injection or compression molding to produce precision surfaces primarily to provide a reusable secondary seal between the adaptor and closure which does not require excessive force or the use of inserts or gaskets and the like to effect a liquid tight seal.

Adaptor 12 has an annular top 22 and an outer skirt 24 depending from its periphery. Outer skirt 24 carries container attachment means in the form of internal threads 26 and closure attachment means in the form of external threads 28. It should be appreciated that other attachment means can be used to secure a closure to the adaptor and to secure the adaptor to the container neck. For example, in both instances snap bead connections can be used. When a snap bead connection is used to secure the closure to the adaptor it also serves as the child resistant lock with a closure bead securing the closure to a flange on the adaptor and the force required to snap the top surface of the closure bead over the bottom surface of the adaptor flange furnishing the chid resistant feature. The top surface of the closure bead and the bottom surface of the adaptor flange are the cooperating child resistant elements or stop surfaces.

Typically, the container 18 is produced by extrusion blow molding which produces imprecisely formed external threads 30 on the container neck 16. When the term "imprecisely formed" is used, it is meant that close tolerances or shapes cannot be maintained. For example, in extrusion-blow molding of a plastic container or in forming a glass or metal container, tolerances usually exceed ±0.015". Thus, even though the annular seating surface 36 on the inside of the adaptor top 22 is flat enough to produce a good seal, the container neck lip 34 will not have the same precision. Therefore, it will be necessary to provide a gasket or insert 32 which will be compressed between the container neck lip 34 and the annular surface 36 of the adaptor 12.

Since the adaptor 12 is to be permanently attached to the container neck 16, there will have to be additional means to secure the adaptor to the container neck beyond the use of a resilient gasket or insert 32 and the cooperating adaptor and container neck threads 26 and 30. Such an additional means of securing the adaptor to the container neck can be by the use of an induction welding. For example, the resilient gasket 32 can be replaced by a metallic foil coated on both sides with a fusible plastic material so that once the adaptor is assembled to the container neck, induction heating will provide permanent seal between the foil and the sealing surface 36 of the adaptor and the foil and lip 34 of the container neck.

It is usually more practical and economical to use standard capping machinery. Particularly since the manufacturer/bottler will receive the adaptor-closure as an assembled, sealed unit. A "permanent" connection can be obtained by using a high capping torque which will wedge the adaptor-container threads. To accomplish this, the container can be provided with a shoulder 40 against which the bottom of adaptor skirt 24 can be brought into abutment when the adaptor 12 or adaptor-closure 10 is attached to the container neck by threading the adaptor in the direction of arrow 38 as seen in FIG. 1.

In the embodiment of FIGS. 1 and 2, a flange 42 is provided at the bottom of adaptor skirt 24 so that the lower annular surface 44 of flange 42 will be brought into abutment with shoulder 40. For a more complete explanation of the ways of obtaining thread wedging or otherwise permanently securing the threaded adaptor to the threaded container neck, reference can be made to my copending application Ser. No. 07/841,705 filed Feb. 26, 1992, now U.S. Pat. No. 5,174,460, issued Dec. 29, 1992.

The primary purpose of flange 42 at the bottom of adaptor skirt 24 is to provide one or more abutments 46 which will act in cooperation with flexible tab 58 on closure 14 to provide a child resistant lock between the closure 14 and adaptor 12.

Closure or cap 14 has a top 48 with an annular outer skirt 50 depending from its periphery. This outer skirt carries attachment means in the form of internal threads 52 which engage the complementary external threads 28 of the adaptor 12.

Since both the adaptor 12 and the closure 14 have been precision molded or have been formed with precision surfaces as by injection molding, a resilient secondary seal can be established between the parts without the use of liners or gaskets, and at openings and closing torques with which the ultimate customer is comfortable; the package has been made "user friendly".

In the embodiment illustrated in FIGS. 1 and 2, the closure 14 has been provided with a resilient inner skirt or plug 54, and the adaptor 12 has been provided with an inner skirt 56. When the closure 14 is threaded onto the adaptor 12, the plug 54 will engage the inner skirt 56 of the adaptor to form a resilient seal.

As the cap 14 is being threaded onto the adaptor 12, the nose or forward end 60 of flexible tab 58 on the closure sidewall 50 will radially clear the trailing end 62 of abutment 46 squeezing the shank 64 of the tab inward to completely clear the abutment 46 as it slides passed it. When the closure 14 is in its fully closed position with the closure plug 54 sealing against the adaptor inner skirt 56 as shown in FIG. 2, the trailing axial stop surface 66 of tab 58 will have passed the leading axial stop surface 68 of abutment 46. As soon as the closure is rotated in an unthreading direction as indicated by arrow 70 in FIG. 1, the axial stop surface 66 of tab 58 will come into abutment with the axial stop surface 68 of abutment 46. This child resistant lock can be opened by pressing inward on the shank 64 of flexible tab 58. A legend may appear on the top 48 of the cap or closure 14 that will instruct the user "to open squeeze tab while unscrewing", or a like message will prompt the user to squeeze the tab before the stop surfaces 66 and 68 come into contact. This Snap-Lok® feature is fully explained along with other embodiments in my U.S. Pat. No. 3,989,152 which shows it applied to a conventional closure and container neck finish.

Referring to FIGS. 3 and 4, an alternate and combined adaptor-closure attachment device and child resistant feature is shown in the form of a bayonet type connection. The short inner skirt 56 and the short inner skirt or plug 54 of the FIGS. 1 and 2 adaptor 12 and closure 14 have been replaced by a longer conical or inwardly tapering inner skirt 72 on the adaptor 12 and a longer cylindrical inner skirt 74 on the closure 14. When the closure has been attached to the adaptor these inner skirts serve the same sealing function as the inner skirts 54 and 56 in the FIGS. 1 and 2 embodiment. Additionally, the skirts 72 and 74 are resilient so that an upwardly directed spring force is imparted by the tapered adaptor skirt 72 to the cylindrical closure skirt 74.

The bayonet connection between the adaptor and closure of FIGS. 3 and 4 takes the form of a recessed ramp lug 78 projecting outwardly from the outer skirt 24 of adaptor 12 and a rectangular or square projection 80 which extends radially inward from the outerskirt 50 of closure 14. The recessed ramp lug has a forward ramp surface 82 and a recess 84. The recess 84 has a forward vertical stop surface 86 and a rearward vertical stop surface 88. When the closure 14 is pushed downwardly on the adaptor 12, the cylindrical inner skirt 74 of the closure being guided by the conical inner skirt 72 of the adaptor, the projections 80 on the closure skirt will pass between adjacent recessed ramp lugs 78 on the adaptor skirt. This may require a twisting motion to assure the projections clear the ramp lugs. With a further twisting or rotation of the closure 14 in a clockwise direction as shown by arrow 88 in FIG. 3, while maintaining a downward force, the projections 80 will slide along the ramp surfaces 82 into the ramp recesses 84. With the rearward surface 90 of projection 80 coming into abutment with the rearward vertical stop surface 88 of the lug 78. Upon release of the downward force on the closure 14, the projections 80 will be retained in the lug recesses 84.

When an attempt is made to twist the closure off in a counterclockwise direction, opposite to the direction shown by arrow 88, the forward vertical stop surface 92 of the projection 80 will come into abutment with the forward vertical stop surface 86 on the recessed ramp lug 78, providing the child resistant feature. The cap or closure 14 must be depressed against the spring force of coacting inner skirts 72 and 74 so that the cap can be rotated in an unthreading direction for removal. This bayonet type of child resistant connection is shown as applied to a closure and container neck in U.S. Pat. No. 3,716,161.

Referring to FIG. 5, the closure-adaptor 10 is shown applied to a metal can 94. The adaptor 12 has a snap flange 96 which snaps into the flanged aperture 98 on the can top 100. The same threaded connection of FIGS. 1 and 2 is used between the adaptor 12 and the cap 14. Likewise the same child resistant Snap-Lok® child resistant stop 46, 58 is used as shown in FIGS. 1 and 2. Sealing between the closure 14 and adaptor 12 is accomplished by contact of annular fin 102 on the inside surface 104 of closure top 48 with the annular sealing lip 104 of adaptor 12.

Figure 6:
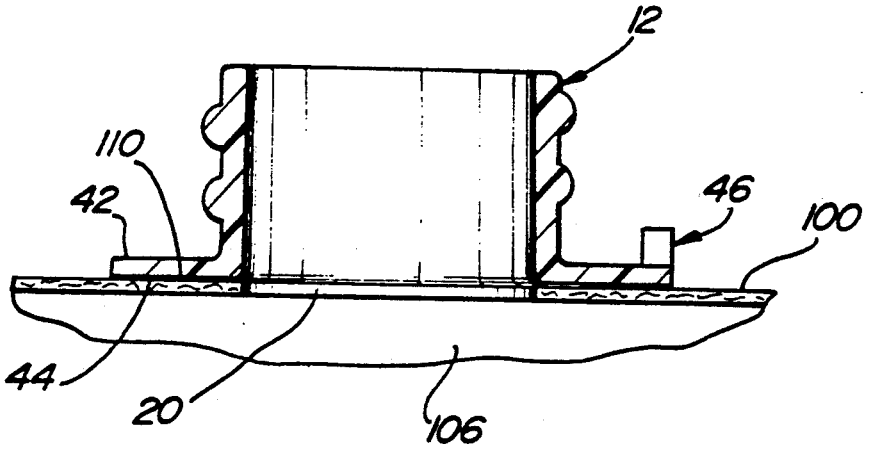
FIG. 6 is a cross sectional view of another adaptor modified for attachment to a container having a flat mounting surface surrounding a dispensing aperture.

In FIG. 6, the adaptor 12 is shown applied to any type of flat top container such as a carton or bag 106 by adhesively bonding or welding the bottom surface 44 of flange 42 to the annular surface 110 surrounding the aperture 20 in the container top 100. The same type of threading connection and child resistant feature shown in the embodiments of FIG. 5 or FIGS. 1 and 2 are used with the adaptor and closure of FIG. 6.

The embodiments of the invention in which an exclusive property or privilege is claimed are defined as follows:

1. The combination of an adaptor and a closure for providing a child resistant feature and a removable closure for a container comprising:

a plastic adaptor molded with precision surfaces including precision closure attachment means of the bayonet type having a recessed ramp lug projecting outwardly from an outer skirt and a precision sealing surface, and further including container engagement means for attachment of said adaptor to the container, and a child resistant locking element;

a plastic closure molded with precision surfaces including precision adaptor attachment means of the bayonet type complementary to said precision closure attachment means on said plastic adaptor having a projection extending radially inward from an outer skirt which engages a recess of said lug and a precision sealing surface complimentary to said adaptor sealing surface, and further including a child resistant locking element complementary to said adaptor child resistant locking element;

the precision sealing surface on at least one of said plastic adaptor and plastic closure is on an axially extending tubular projection; and wherein said container attachment means provides a permanent attachment of said adaptor to said container, said adaptor and closure precision attachment means provide a resealable connection between the precision sealing surface on the axially extending tubular projection on said at least one of said plastic adaptor and plastic closure and the precision sealing surface on the other of said plastic adaptor and plastic closure, and said adaptor child resistant locking element includes an axially extending surface of said recess and said closure child resistant locking element includes an axially extending surface of said projection which coact to prevent removal of said closure from said adaptor; pushing down and twisting of said closure relative to said adaptor to unlock said child resistant locking elements being required each time said closure is removed from said adaptor.

2. The combination according to claim 1 wherein said plastic adaptor has said axially extending tubular projection in the form of an annular flexible inner skirt tapering inwardly from a top surface, and said closure has said axially extending tubular projection in the form of an annular inner skirt, said skirts providing said adaptor and closure precision sealing surfaces and providing a spring bias for operation of said bayonet attachment means.

* * * * *